US008574092B2

(12) United States Patent
Galloway et al.

(10) Patent No.: US 8,574,092 B2
(45) Date of Patent: Nov. 5, 2013

(54) GOLF CLUB HEAD WITH ARTICULATED HOSEL

(75) Inventors: J. Andrew Galloway, Escondido, CA (US); Yvonne Galloway, legal representative, Escondido, CA (US); William C. Watson, Temecula, CA (US)

(73) Assignee: Callaway Golf Company, Carlsbad, CA (US)

( * ) Notice: Subject to any disclaimer, the term of this patent is extended or adjusted under 35 U.S.C. 154(b) by 305 days.

(21) Appl. No.: 13/245,630

(22) Filed: Sep. 26, 2011

(65) Prior Publication Data

US 2012/0083358 A1 Apr. 5, 2012

Related U.S. Application Data

(60) Provisional application No. 61/388,456, filed on Sep. 30, 2010.

(51) Int. Cl.
*A63B 53/02* (2006.01)

(52) U.S. Cl.
USPC ..... 473/244; 473/305

(58) Field of Classification Search
USPC ..... 473/288, 307, 244–248, 305
See application file for complete search history.

(56) References Cited

U.S. PATENT DOCUMENTS

| | | | | |
|---|---|---|---|---|
| 2,067,556 | A * | 1/1937 | Wettlaufer | 473/308 |
| 2,219,670 | A * | 10/1940 | Wettlaufer | 473/247 |
| 6,723,000 | B1 * | 4/2004 | Dombrowski | 473/239 |
| 7,938,735 | B2 * | 5/2011 | Lau | 473/288 |
| 7,967,700 | B2 * | 6/2011 | Stites | 473/342 |
| 2011/0118045 | A1 * | 5/2011 | Sato et al. | 473/307 |
| 2011/0218051 | A1 * | 9/2011 | Stites | 473/342 |

* cited by examiner

*Primary Examiner* — Stephen L. Blau
(74) *Attorney, Agent, or Firm* — Rebecca Hanovice; Michael A. Catania; Sonia Lari

(57) ABSTRACT

A golf club head having a body, a hosel, and a bolt that connects the hosel to the body such that the hosel can rotate around the bolt is disclosed herein. In one embodiment, a worm gear engages gear teeth located at an interface of the hosel and the body, and turning the worm gear causes the hosel to rotate around the bolt. In another embodiment, a circular wedge is disposed between the hosel and the body, and rotating the circular wedge around the bolt changes the orientation of the hosel with respect to the body.

10 Claims, 2 Drawing Sheets

GOLF CLUB HEAD WITH ARTICULATED HOSEL

CROSS REFERENCES TO RELATED APPLICATIONS

The present application claims priority to U.S. Provisional Patent Application No. 61/388,456, filed on Sep. 30, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a hosel configuration that permits changes to be made to the orientation of the hosel with respect to the golf club head without the use of bending fixtures or bending tools.

2. Description of the Related Art

Technical innovation in the configuration, material, construction and performance of golf clubs has resulted in a variety of new products. The advent of metals as a structural material has largely replaced natural wood for wood-type golf club heads, and is but one example of this technical innovation resulting in a major change in the golf industry. Another important example is the use of composite or plastic materials to form components of golf club heads, including the face, crown, and/or sole.

A further example of innovation in the construction and design of golf clubs is the use of configurable hosels that permit golfers to change the orientation of golf club heads with respect to their shafts. For example, U.S. Pat. No. 5,626,528 to Toulon teaches a unitary hosel having a continuous curved bottom groove extending completely about the hosel to form a reduced bending moment region enabling the making of minor adjustments in both lie and face angle of the club. Another example is U.S. Pat. No. 6,186,903 to Beebe et al., which teaches a hosel having a notch formed in the lower surface of the hosel neck. This patent teaches that the desired orientation of the hosel bore can be adjusted by bending the hosel neck at the notch. The drawback of the hosel configurations taught by these two patents is the fact that they require significant bending pressure to change the orientation of the club head with respect to the shaft.

Although the prior art has disclosed many variations of golf club heads, the prior art has failed to provide a club head with a hosel that permits easy modification of the golf club head orientation.

BRIEF SUMMARY OF THE INVENTION

Golfers have personalized preferences for the orientation of the hosel on their golf clubs. Many golfers prefer to change the orientation of a golf club hosel on the clubs. The present invention provides an improvement over prior art configurations and constructions because it makes it easy for golfers to change the hosel orientation even after construction of the golf club is complete.

An aspect of the invention is a golf club head comprising a body, a hosel, and a bolt, wherein the bolt connects the hosel to the body and wherein the hosel can rotate around the bolt. In further embodiments, the hosel is angled with respect to the bolt, and rotating the hosel around the bolt changes the angular orientation of the hosel with respect to the body. In some embodiments, the hosel may be composed of metal or composite material. In other embodiments, the body may be composed of metal or composite material.

In one embodiment, the golf club head further comprises gear teeth at the interface between the hosel and the body and a worm gear engaging the gear teeth, wherein turning the worm gear moves the gear teeth and rotates the hosel around the bolt. In further embodiments, the worm gear is composed of a metal or composite material. In other embodiments, the golf club head further comprises a washer affixed to the bolt.

In another embodiment, the golf club head further comprises a circular wedge disposed between the hosel and the body and secured therebetween by the bolt, wherein the circular wedge tilts the hosel such that it forms an angle with the body and wherein the circular wedge can rotate around the bolt. In further embodiments, rotating the circular wedge around the bolt changes the orientation of the hosel with respect to the body. In some embodiments, the circular wedge is composed of a metal or a composite material. In a further embodiment, the golf club head further comprises a washer affixed to the bolt.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is generally directed to a golf club head with a hosel configuration that allows a user to change the orientation of the golf club head with respect to a connected shaft.

Figure 1:
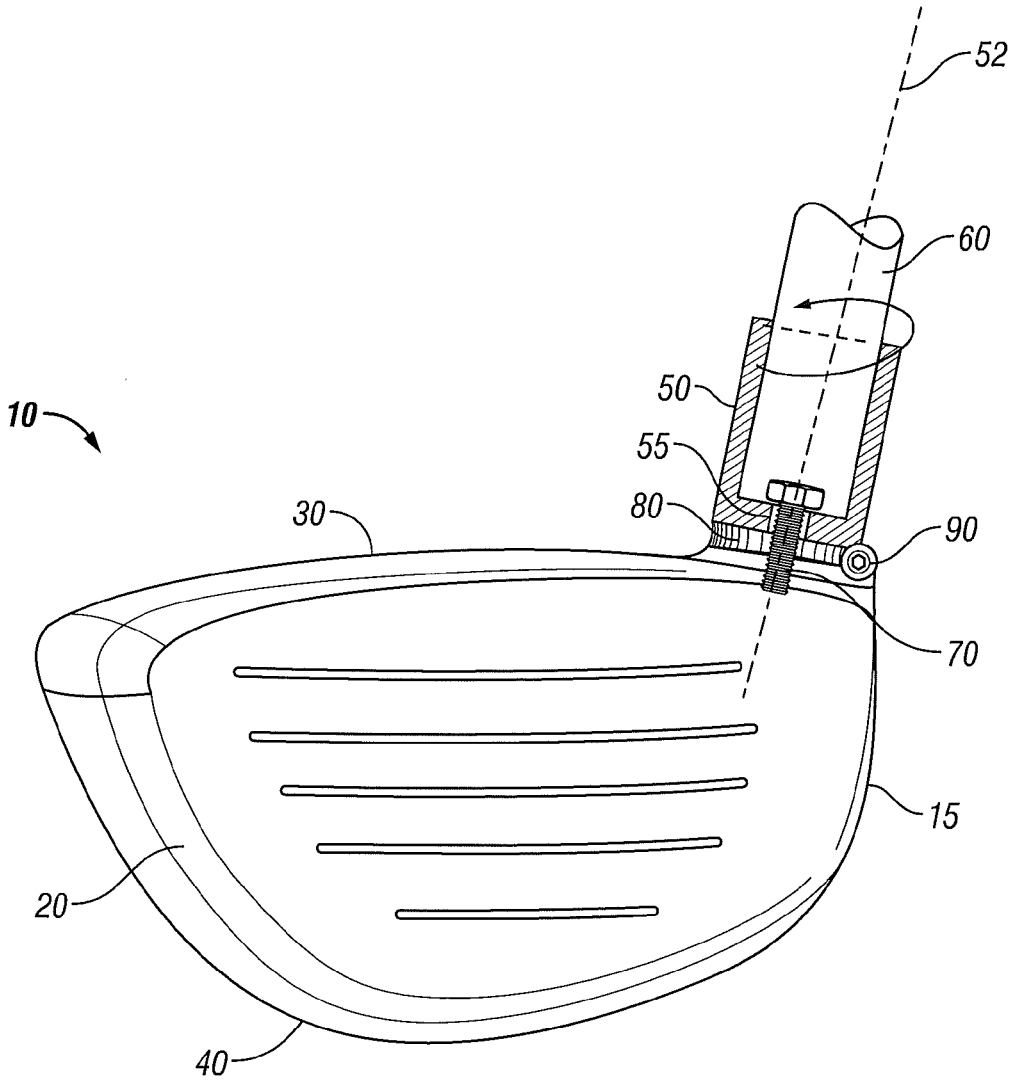
FIG. 1 is front view of a golf club head according to an embodiment of the present invention.

A preferred embodiment of the present invention is shown in FIG. 1. The golf club head 10 shown in FIG. 1 has a hollow interior, not shown, and is generally composed of a body 15 comprising a face component 20, a crown 30, and a sole 40, and a hosel 50. The club body 15 also may optionally have a ribbon, skirt, or side portion (not shown) disposed between the crown 30 and sole 40 portions. A shaft 60 is inserted in the hosel 50. The hosel 50 includes a center hole 55 to receive a bolt 70, which attaches the hosel 50 to the head 10 and allows the hosel 50 to rotate. Because the hosel 50 centerline 52 is at an angle to the bolt 70, the hosel tilts in various directions when rotated around the bolt 70. This changes the angle of the hosel 50. To rotate the hosel 50, gear teeth 80 are located on the hosel 50 at the interface between the hosel 50 and the golf club body 15. A worm gear 90 anchored to the club body 15 engages the gear teeth 80. Turning the worm gear 90 rotates the tilted hosel to a preferred orientation. The worm gear 90 may be turned by hand or by a tool.

Figure 2:
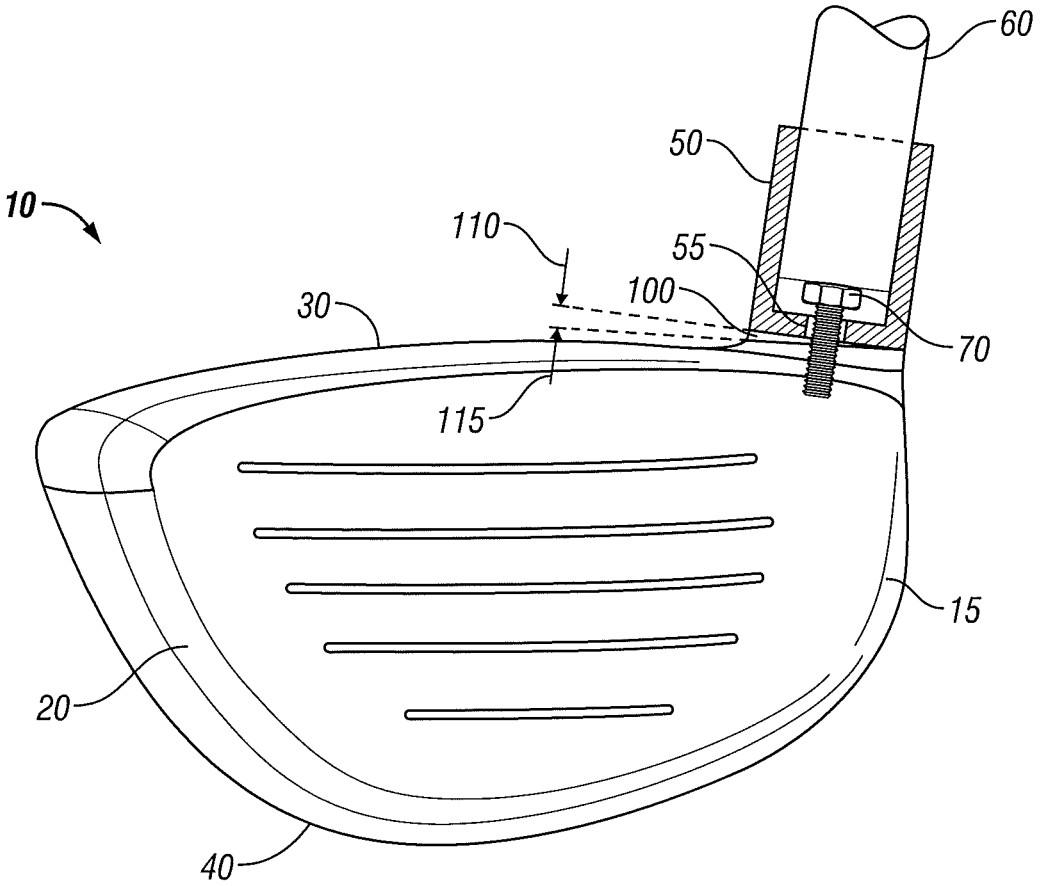
FIG. 2 is front view of a golf club head according to another embodiment of the present invention.

An alternative embodiment of the present invention is shown in FIG. 2. The golf club head 10 shown in FIG. 2 also has a hollow interior, not shown, and is generally composed of a body 15 comprising a face component 20, a crown 30, and a sole 40, and a hosel 50. The club body 15 also may optionally have a ribbon, skirt, or side portion (not shown) disposed between the crown 30 and sole 40 portions. A shaft 60 is inserted in the hosel 50. The hosel 50 includes a center hole 55 to receive a bolt 70, which attaches the hosel 50 to the head 10 and allows the hosel 50 to rotate. This embodiment includes an intermediate circular wedge 100 disposed between the hosel 50 and the golf club body 15. Lines 110, 115 illustrate how the circular wedge 100 is thicker on one side than another. The circular wedge 100 is rotated around the hosel 50 and the bolt 70, which tips the hosel. The wedge 100 allows the hosel 50 and thus the shaft 60 to remain in the initial orientation. The wedge 100 may be rotated by hand or by a tool. The hosel 50 will be keyed to the installation bolt 70 or to the body 15 to restrict rotation.

In both embodiments, a Bellville washer or an elastic grommet can be used to clamp the hosel 50 but allow for small changes in orientation while remaining in constant contact with the club head body 15.

In further embodiments, the face component 20, crown 30, sole 40, and hosel 50 may be made from cast or forged metals or from composite materials, and may be formed integrally or pieced together. In yet other embodiments, the face component 20, crown 30, sole 40, and hosel 50 each may be composed of different materials. The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7749097, the disclosure of each of which is hereby incorporated in its entirety herein.

The golf club head of the present invention may be constructed to take various shapes, including traditional, square, rectangular, or triangular. In some embodiments, the golf club head of the present invention takes shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos., 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, the disclosure of each of which is incorporated in its entirety herein. The golf club of the present invention may also have the variable face thickness patterns disclosed in U.S. Patent Application Publication No. 20100178997, the disclosure of which is incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body;

a hosel;

a bolt, wherein the bolt connects the hosel to the body;

wherein the hosel can rotate around the bolt; gear teeth at an interface between the hosel and the body; and a worm gear engaging the gear teeth, wherein turning the worm gear moves the gear teeth and rotates the hosel around the bolt.

2. The golf club head of claim 1, wherein the hosel is angled with respect to the bolt.

3. The golf club head of claim 1, wherein rotating the hosel around the bolt changes the angular orientation of the hosel with respect to the body.

4. The golf club head of claim 1, wherein the hosel is composed of a metal material.

5. The golf club head of claim 1, wherein the hosel is composed of a composite material.

6. The golf club head of claim 1, wherein the body is composed of a metal material.

7. The golf club head of claim 1, wherein the body is composed of a composite material.

8. The golf club head of claim 1, wherein the worm gear is composed of a metal material.

9. The golf club head of claim 1, wherein the gear teeth are composed of a metal material.

10. The golf club head of claim 1, further comprising a washer affixed to the bolt.

* * * * *